US006381993B1

(12) United States Patent
Daiber

(10) Patent No.: US 6,381,993 B1
(45) Date of Patent: May 7, 2002

(54) APPARATUS FOR FORMING LARGE ROLLS OF TUBULAR KNITTED FABRIC

(75) Inventor: Hermann Daiber, Whitsett, NC (US)

(73) Assignee: Flynt Amtex, Inc., Burlington, NC (US)

( * ) Notice: Subject to any disclaimer, the term of this patent is extended or adjusted under 35 U.S.C. 154(b) by 0 days.

(21) Appl. No.: 09/962,891

(22) Filed: Sep. 25, 2001

(51) Int. Cl.[7] ..... D04B 27/34
(52) U.S. Cl. ..... 66/153; 66/151
(58) Field of Search ..... 66/147, 149 R, 66/151, 152, 153; 242/548, 157.1, 548.1, 476.7, 476.9

(56) References Cited

U.S. PATENT DOCUMENTS

| | | | | | |
|---|---|---|---|---|---|
| 4,759,512 | A | * | 7/1988 | Gaiser | 242/476.7 |
| 4,879,886 | A | * | 11/1989 | Okada et al. | 66/151 |
| 4,888,963 | A | | 12/1989 | Scherzinger et al. | 66/151 |
| 4,986,483 | A | * | 1/1991 | Ryu et al. | 242/476.7 |
| 5,457,967 | A | * | 10/1995 | Scherzinger | 66/151 |
| 5,575,162 | A | * | 11/1996 | Gray et al. | 66/151 |
| 6,023,949 | A | * | 2/2000 | Lonati et al. | 66/151 |
| 6,082,143 | A | | 7/2000 | Noonkester et al. | 66/151 |

OTHER PUBLICATIONS

Photocopy of brochure entitled Knitline:Tompkins;vol. 2 No.2; 1 p., Winter 2001.

Advertisement of Tompkins Brothers Company, Inc. etitled Model R Series–Frame Size 1, 1 p.; 1996.

* cited by examiner

*Primary Examiner*—Danny Worrell
(74) *Attorney, Agent, or Firm*—Womble Carlyle Sandridge & Rice, PLLC; C. Robert Rhodes

(57) ABSTRACT

A method and apparatus for producing large rolls of tubular fabric knitted on a small diameter circular knitting machine of the type having fabric takedown rollers for pulling the fabric from the knitting cylinder, and a takeup roller for winding up the fabric into a roll, including a traversing mechanism that is operatively associated with and positioned upstream of the tubular fabric takedown rollers so that the fabric is moved back and forth along the length of the take down rollers, so that the width of the fabric roll wound upon the takeup roller is substantially the length of the take down rollers. Further, the fabric leaving the takedown rollers is surface driven to provide constant speed and tension.

28 Claims, 8 Drawing Sheets

APPARATUS FOR FORMING LARGE ROLLS OF TUBULAR KNITTED FABRIC

FIELD OF THE INVENTION

The present invention relates generally to tubular fabric formed on small diameter circular knitting machines and, more particularly, to an apparatus and knitting machine that produces large rolls of such material.

BACKGROUND OF THE INVENTION

Small diameter circular knitting machines have been in use for many years in the textile industry. These machines are especially designed for knitting narrow tubular single jersey and rib knit polyester and cotton fabrics, and combinations thereof, to be used as cuffs on sleeves or trousers, as liners for specialty garments, etc.

While there are several types and models of small diameter circular knitting machines, they each operate on the same general principles. A small diameter knitting cylinder and dial assembly equipped with latch needles (knitting needles) receives ends of polyester or other yarn that are fed from surrounding creels. A small diameter tubular knitted fabric is thus formed on the latch needles and is continuously and synchronously drawn downward by the machine's takedown assembly. The takedown assembly includes two or more takedown rollers that frictionally engage and pull downward on the tubular fabric. As is conventional in machines of this type, a windup mandrel is positioned below the takedown rollers to form a narrow roll (like a coiled fire hose) of fabric having a width corresponding to the width of the tubular, but flattened, knitted fabric. The roll is wound around the mandrel, the mandrel being independently driven and controlled by a clutch assembly.

There are a number of problems inherent in this system of forming rolls of fabric. First, because these rolls are formed by a buildup of concentric layers, the rolls are limited in the diameter that can be formed. Thus the length of fabric on a roll must also be limited. As a result, these narrow rolls of fabric must be "doffed", or removed, about every 35 to 40 minutes, depending upon the production rate of the machine. This translates to a substantial labor requirement wherein machine operators must frequently remove the full rolls and ready the machine for a new roll. Similarly, the end users of the narrow fabric rolls are forced to frequently interrupt the production of apparel or the like in which the tubular fabric is being incorporated in order to get a new roll.

In such machines, typically the mandrel, or core, of the narrow roll is driven independently by a clutch-controlled motion. As a result, the tension created in the fabric is not uniform throughout the roll. A great deal more tension tends to be induced on the inner, or first, layers than on the outer layers because the mandrel exerts a greater force on the inner layers and less force on the outer layers. This is caused by decreasing the angular velocity of the outer layers as the clutch tends to brake. Fabric, like any other material having a substantial elastic characteristic, develops a memory when held in a certain stretched or unstretched condition for any appreciable length of time. The problem that this creates is that the end users must produce apparel with a product that does not exhibit uniform characteristics throughout its length. For example, if the tubular fabric is being cut into specified lengths for use as cuffs on garments, the first cuffs, which are stretched less, will be more loosely fitting because the less stretched fabric will have less tendency to return to a narrow, stretched shape. On the other hand, the last cuffs formed will fit more tightly as the material that is stretched during the fabric formation tends to return to its narrow, stretched shape. This presents a quality dilemma for the end user who often must discard lengths of the knitted fabric as unusable.

Yet another problem inherent in the production of narrow rolls is wastage resulting from knitting machine failures such as sudden stoppage, which causes the very narrow rolls to collapse and unravel, rendering them useless.

SUMMARY OF THE INVENTION

The present invention is directed to an apparatus and method that addresses each of the problems described above.

The essence of the present invention is a takeup system that forms a larger, wider, roll of tubular knitted fabric and also maintains a constant tension on the fabric wound onto the takeup package. In its simplest form, the system includes a traversing mechanism that is positioned between the knitting cylinder and the takedown rollers. The traversing mechanism moves at a controlled rate across the path of the fabric tube to build a wound package of a substantially constant diameter. Secondly, the takeup package is surface driven to ensure a constant tension on the fabric on the package.

The traversing mechanism is mounted between the knitting cylinder and the takedown rollers and includes a traversing control spindle that extends substantially across the width of the machine's takedown assembly. The traversing control spindle is mounted by flange bearings at each end attached to the upper takedown bracket. A reversing nut is operatively mounted on the traversing control spindle and reciprocates along tracks in the traversing control spindle. Upon reaching the end of the track, the nut reverses direction and moves back to the opposite end, and so on. If the tracks were provided with a conventional, constant pitch, the reciprocating motion would be accelerated near the ends of the spindle. Therefore, an important aspect of the spindle track pattern in the present invention is that the pitch of the track pattern is steeper at the ends of the track and is more gradual in the middle of the track. This unique design causes the reversing nut to move more slowly when it approaches the ends of the track than it does at the middle of the spindle, which actually causes a more constant traversing speed. As a result, the fabric being pulled downwardly is more evenly wound across the width of the fabric roll.

A traversing plate is fastened to one end of the reversing nut so that, as the traversing control spindle rotates, the traversing plate moves with the reversing nut back and forth along the spindle. A guide rod extends through a slot in the traversing plate and is attached on opposite ends to the flange bearings. The guide rod keeps the traversing plate in a constant horizontal and vertical alignment with respect to the takedown rollers. Extending outwardly from the bottom of the traversing plate is a narrow, flat guide plate that is slightly wider than the width of the tubular fabric being processed. Small rollers having rotational axes perpendicular to the takedown rollers are attached on opposite sides of the guide plate and protrude forwardly outward so that they contact the vertical side edges of the tubular fabric. To stabilizethe fabric, a separate fabric spreader plate is inserted within the tubular fabric sleeve to spread and stabilize the fabric being pulled through by the takedown rollers. Thus, as the spindle rotates, the reversing nut with attached traversing plate moves back and forth along the length of the spindle. The guide plate, with rollers, moves the fabric with the spreader plate in similar fashion back and forth substantially along the length of the takedown rollers as the fabric is pulled through the takedown rollers.

A second aspect of the invention is to provide constant tension on the rolled fabric. Toward this end, the takeup mandrel and clutch assembly of the conventional machine are removed and replaced by a freely rotating takeup roller that extends across a substantial width of the lower takedown bracket. Opposite ends of the takedown roller shaft are held by spring-biased arms that are each mounted on opposing walls of the lower takedown bracket.

The independent drive system of the conventional machine is removed from the machine of the present invention and is replaced by a knurled, cylindrical surface driving windup roller that extends across the width of the lower takedown bracket. Opposite ends of the windup roller shaft are mounted within pillow block bearings. The windup roller is interconnected with the takedown rollers by a gear chain and driven in a ratioed relationship thereto. Thus, as the takedown rollers pull the fabric downward for winding upon the takeup roller, the windup roller is driven slightly slower, relaxing some of the tension in the fabric. The biasing arms holding the takeup roller and thus the fabric roll against the windup roller. The windup roller then drives the fabric roll from the roll's outer surface at a constant speed. This constant surface speed ensures that a constant tension is induced on the knitted fabric as it is being wound around the takeup roller. Therefore, a fabric roll is formed that has a substantially uniform outer shape, holds 5 to 10 times more fabric than a conventional, narrow roll, and delivers a fabric wound at a substantially uniform tension.

These and other aspects of the present invention will become apparent to those skilled in the art after a reading of the following description of the preferred embodiment when considered with the drawings.

DESCRIPTION OF THE PREFERRED EMBODIMENTS

Figure 1:
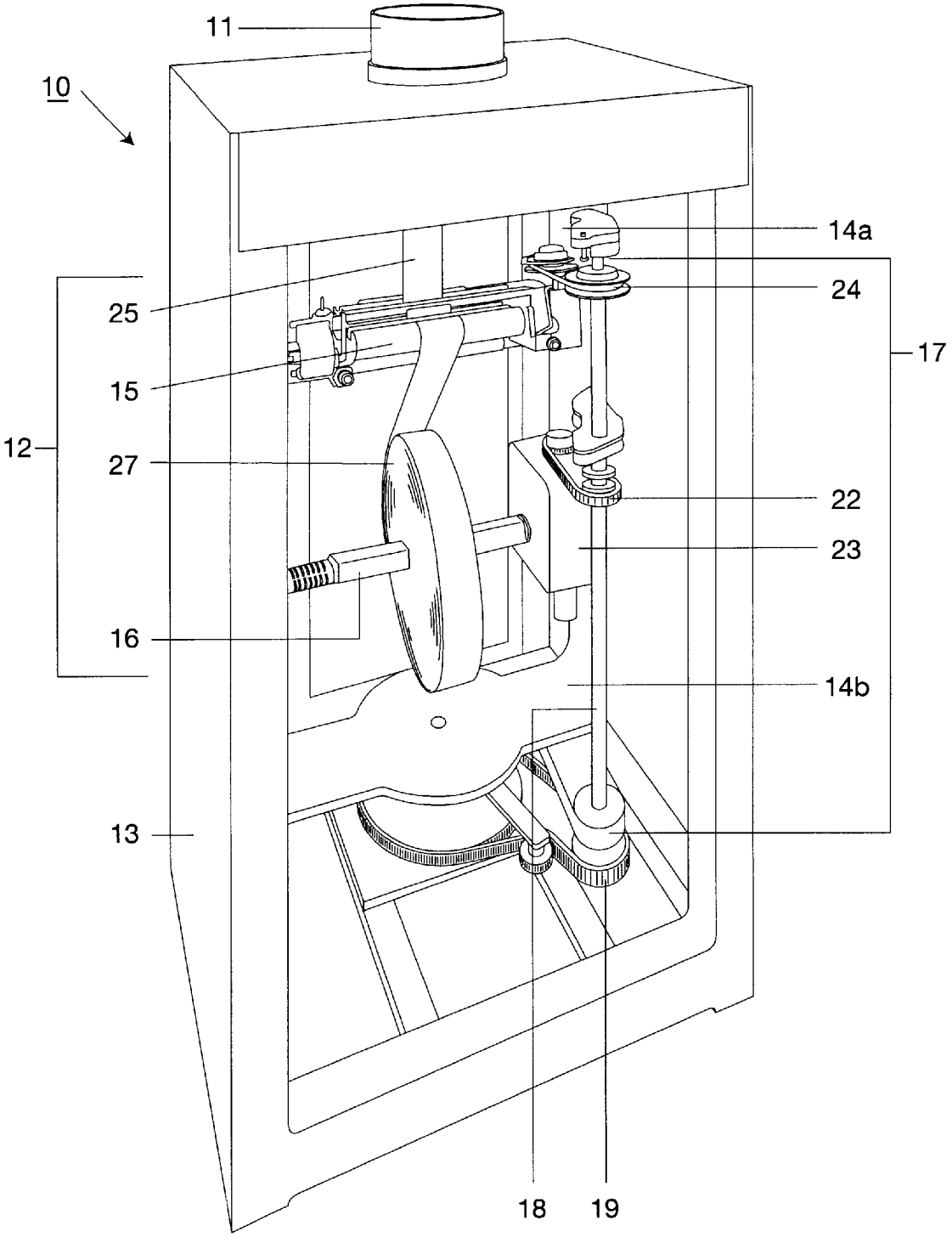
FIG. 1 (PRIOR ART)
FIG. 1 is a front perspective view of the prior art small diameter circular knitting machine.

Referring now to FIG. 1, shown generally as 10 is a representative small diameter circular knitting machine known in the art. The machine shown in FIG. 1 is manufactured by Tompkins Brothers Company, Inc. of Syracuse, New York as Model No. R0508. This type of machine is used for knitting inserts, cuffs, liners, etc., and is representative of other small diameter machines manufactured by other suppliers. In operation, the knitting cylinder and dial 11 equipped with knitting needles (not shown in detail) forms a tubular rib knit fabric 25 at the top of the machine, as a takedown assembly, shown generally as 12, mounted within a stable frame 13, rotates below. The takedown assembly 12 comprises upper and lower takedown brackets 14*a* and 14*b,* a plurality of take down rollers 15, and a windup mandrel 16. A drive system 17 controls the coordinated movement of the rollers 15 and mandrel 16. The drive system 17 is interconnected to and driven by the rotation of the knitting cylinder and dial 11. While a detailed description is not necessary for an appreciation of the present invention, the drive system basically includes a shaft 18 that links gear and chain assemblies 19 and 22, and pulley assembly 24. As shaft 18 is rotably driven, gear and chain assembly 19 causes the takedown assembly to rotate. The rotation of shaft 18 also drives gear and chain assembly 22 that engages a mechanical clutch 23. The mechanical clutch 23 controls the rotation of the mandrel 16.

As the knitting cylinder and dial 11 forms the tubular knitted fabric 25 and the takedown assembly 12 rotates, the takedown rollers 15, which are driven by pulley assembly 24, rotate to frictionally engage and pull the fabric 25 downwardly from cylinder 11 and flatten it for rolling up. The flattened fabric 25 is wound into a roll 27 rotably by mandrel 16. The windup of the roll 27 is thus driven from the center of the roll 27 by the mandrel 16. The resulting roll 27, which is the width of the flattened fabric 25, has a relatively large diameter to width ratio. As a result, roll 27 tends to be unstable and easily collapses due to machine stoppages or handling.

Figure 2:
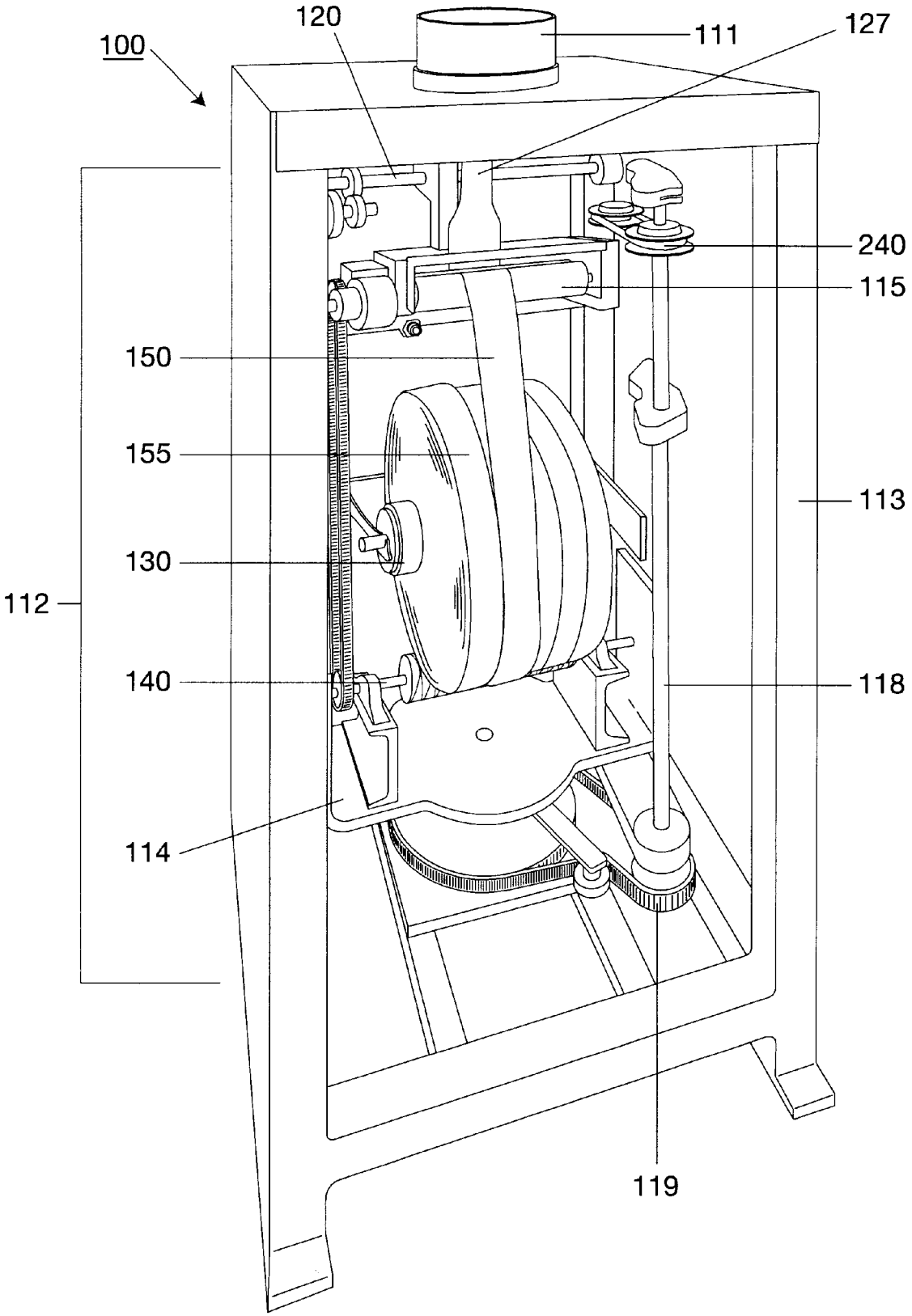
FIG. 2 is a front perspective view of the apparatus and small diameter circular knitting machine of the present invention.

In a preferred embodiment of the present invention, the drive system and rollup assemblies for the small diameter circular knitting machine are substantially different from the prior art. As shown in FIG. 2, the present invention provides a small diameter circular knitting machine, shown generally as 100. Knitting machine 100 comprises a knitting cylinder and dial 111 (not shown in detail) mounted atop a stable frame 113. Mounted within the frame 113 is the takedown mechanism, shown generally as 112. The takedown mechanism comprises a takedown bracket 114 having upper and lower bracket portions. The knitting cylinder 111, frame 113, and takedown bracket 114 are functionally the same as the prior art knitting machine shown in FIG. 1. The takedown mechanism, however, is substantially different.

The takedown mechanism 112 of the present invention includes a traversing mechanism 120, takedown rollers 115, a takeup roller assembly 130, a windup roller assembly 140, and a drive system.

Figure 3:
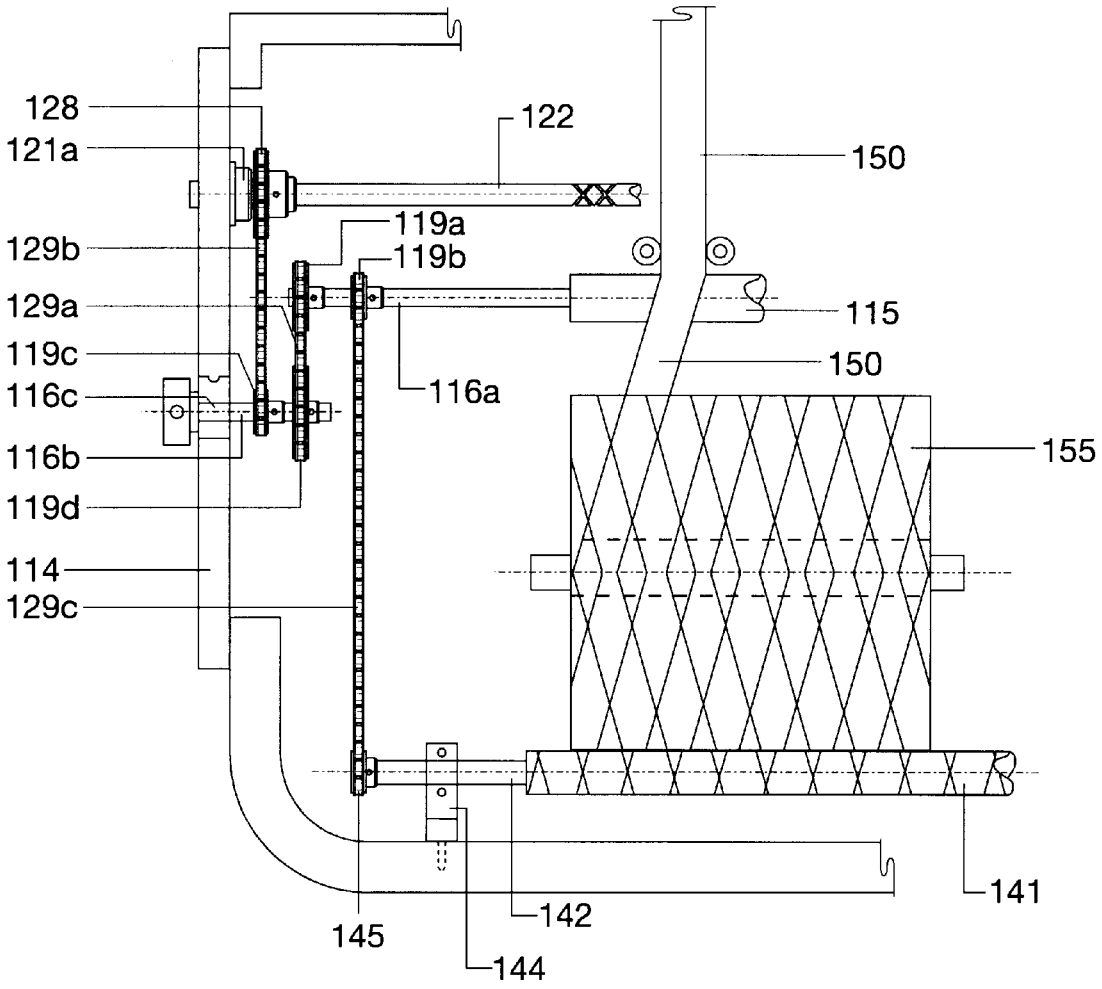
FIG. 3 is a schematic of the drive system of the present invention shown in FIG. 2.

As seen by comparing the prior art machine of FIG. 1 with the present invention of FIG. 2, the drive system of the present invention is best understood. A schematic of the drive system of the present invention is shown in FIG. 3, in part. The gear and chain assembly 22 and mechanical clutch 23 of the prior art machines have been removed from the machine of the present invention. As shaft 118 is rotably driven, gear and chain assembly 119 causes the takedown assembly 112 to rotate. Shaft 118 is still connected to a pulley assembly 240 that drives the takedown rollers 115. It is the rotation of the takedown rollers 115 that drives the takedown system 112 of the present invention. The rotation of the takedown rollers 115 drives the interconnected windup roller assembly 140 (and windup roller 141) and the traversing mechanism 120 (and traversing control spindle 122), each turning at a selected rotational speed. That is, an extension 116*a* of one of the takedown roller 115 shafts has two sprockets affixed along its length. The first sprocket, 119*a,* is interconnected to sprocket 119*d* by a chain 129*a*. Sprocket 119*d* is rotably mounted to a shaft 116*b* that is held in place by a bearing sleeve 116*c* formed in the wall of the takedown bracket 114. A second sprocket 119*c* is rotably mounted on shaft 116*b* and is interconnected by chain 129*b* to sprocket 128 that is mounted on one end of the traversing control spindle 122. Further, the second sprocket 119*b* mounted on takedown roller shaft 116*a* is interconnected to sprocket 145 on windup roller shaft 142 by chain 129*c*. Sprocket gear ratios are selected such that the takedown roller shaft 116*a* turns approximately 4.4 times for 1 turn of the traversing control spindle 122. Traversing control spindle 122 moves a traversing plate, described in detail below. The takedown roller 115 surface turns 1.25 times faster than the windup roller 141 surface, ensuring that some of the tension is relaxed before being wound by windup roller 141. Thus, as the gear and chain assembly 119 is driven, the takedown rollers 115, traversing mechanism 120, and windup roller assembly 140 are interconnectedly driven in unison.

Figure 4:
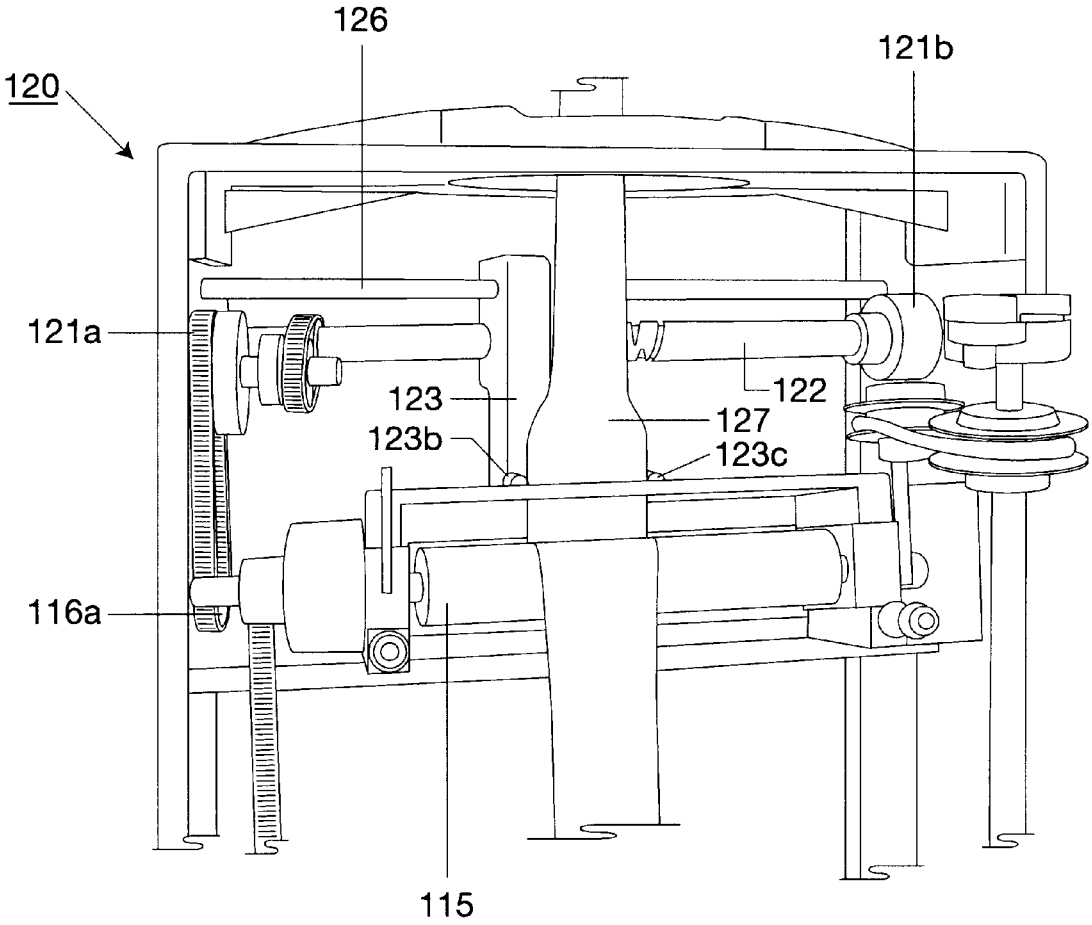
FIG. 4 is a front perspective view of the traversing mechanism of the present invention.
Figure 5:
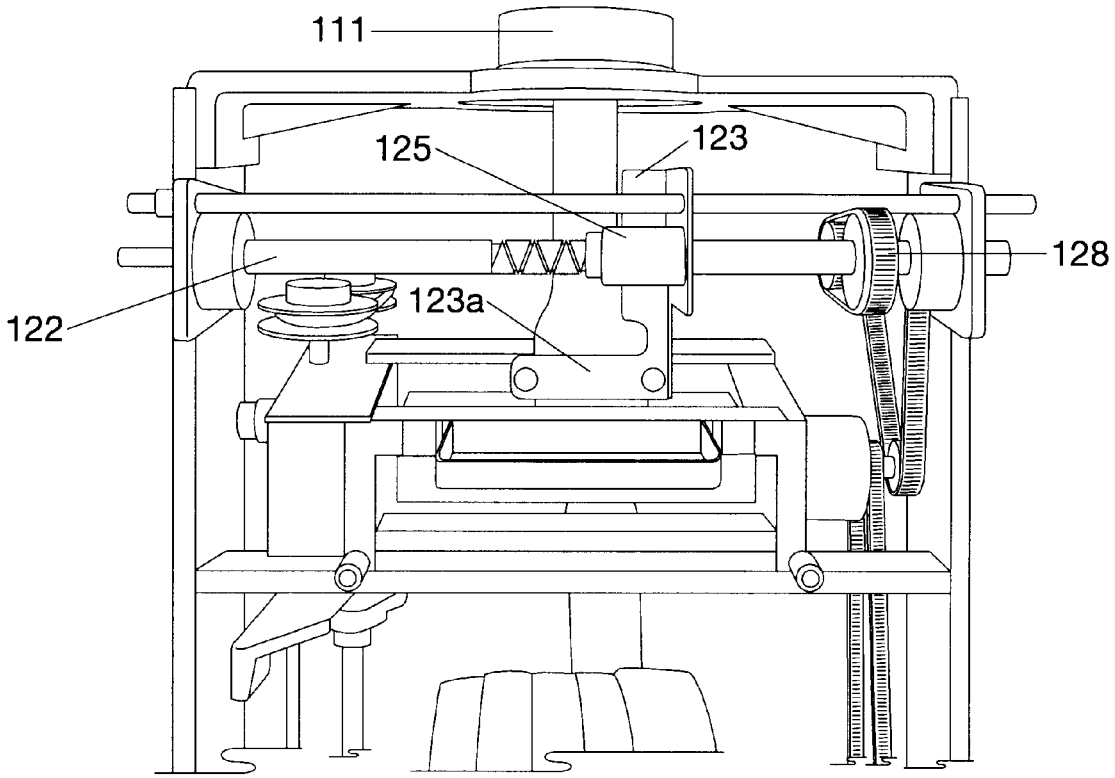
FIG. 5 is a rear perspective view of the traversing mechanism of the present invention.

In operation, as with the conventional small diameter machines, a tubular knitted fabric 150 is formed on knitting cylinder and dial 111 atop the machine. The frame 113 and knitting cylinder and dial 111 are taken from the Model R0508 knitting machine manufactured by Tompkins Brothers Company, Inc. Whereas in the conventional machine the fabric 25 first encounters the takedown rollers 15 on its straight vertical path downward, the knitted fabric 150 of the present invention first encounters the traversing mechanism 120. FIGS. 4 and 5 show the front and rear perspective views of the traversing mechanism 120. The traversing mechanism 120 comprises opposed flange bearings 121*a* and 121*b*, a traversing control spindle 122, a reversing nut 125, a traversing plate 123, a guide rod 126, and a sprocket 128.

Figure 6:
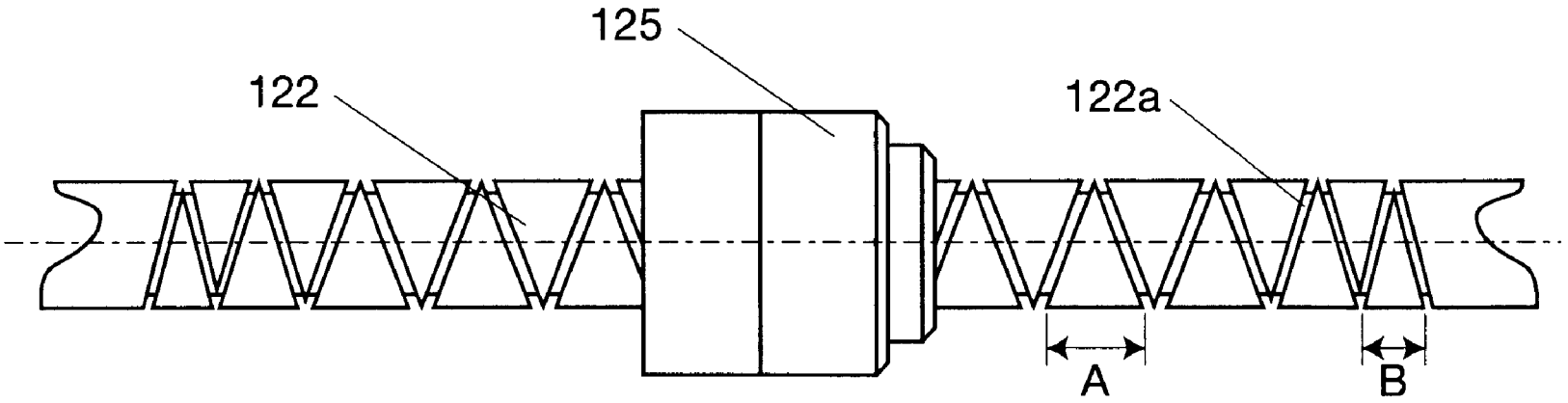
FIG. 6 is a perspective view of the traversing control spindle of the present invention.

As the takedown rollers 115 rotate, the takedown roller shaft extension 116*a* with sprockets 119*a* and 119*b*, and chains 129*a* and 129*b* connected thereto, drives the traversing mechanism 120 via sprocket 128. The rotation of the traversing control spindle 122 causes reversing nut 125 to move back and forth along the length of the spindle 122 tracks 122*a*. Tracks 122*a* formed in spindle 122, control the speed of movement of the reversing nut 125 along the spindle 122. Conventional spindles used in other than textile operations typically have tracks that are uniformly spaced along their lengths; however, as will be understood by those skilled in the art, when the traversing nut 125 approaches and departs each end of the spindle track 122*a*, less material (fabric) is deposited at the ends of the roll than in the middle, or center, of the roll. This effect results in a "football" shaped roll of fabric, which tends to be dimensionably unstable when packaged, shipped, and stored. Thus, the tracks 122*a* formed in the spindle 122 of the present invention, are more widely spaced in the middle of the spindle 122 and are more closely spaced at the outer ends of the spindle 122. This is best seen in FIG. 6. The pattern of tracks 122*a* are formed so that there is a variable lead with increasing dwell time on both ends of tracks 122*a*. The optimal pattern was determined through testing and calculating the length of time the fabric 150 needed to dwell on the outer ends of the spindle track 122*a*. As those skilled in the art will appreciate, if direction is reversed too quickly at the ends of the tracks 122*a*, more fabric is deposited at the center of the roll. The spacing of the tracks at the center of the spindle 122 is 0.825 inches (see dimension A in FIG. 6) and tapers downward to a spacing of approximately 0.481 (see dimension B in FIG. 6) inches at the ends of spindle 122 tracks 122*a*. The design of the spindle 122 tracks 122*a* of the present invention effectively causes the reversing nut 125 to decrease speed at the ends of the spindle 122 track 122*a*, which in turn ensures an even surface across the width of the roll 155 of knitted fabric. As those skilled in the art will appreciate, the spacing of the tracks may be varied depending upon the rate of fabric production, the type and shape of fabric, roller lengths, etc.

Connected to one end of the reversing nut 125 is the traversing plate 123. As the reversing nut 125 moves back and forth along traversing control spindle 122, the traversing plate 123 moves with it. Traversing plate 123 has a lower guide portion 123*a* that is oriented generally parallel to the traversing control spindle 122 and parallel to the direction of travel of reversing nut 125. Guide portion 123*a* is dimensioned to be wider than the width of the fabric 150 being pulled down. On either side of the guide portion 123*a* are guide rollers 123*b* and 123*c*. Guide rollers 123*b* and 123*c* are, in operation, configured so that they are positioned on either side of the knitted fabric tube being pulled downward by takedown rollers 115. As the traversing plate 123 moves back and forth along the traversing spindle 122, the guide rollers 123*b* and 123*c* urge the fabric sleeve 150 back and forth with the traversing plate 123. To further ensure stability in this high speed knitting operation, a fabric spreader plate 127 is positioned inside the downwardly drawn knitted fabric sleeve 150. The spreader plate is a thin, separate "floating" plate that spreads the knitted tube by approximately 10 percent so that the fabric 150 is more stable as it is engaged by the takedown rollers 115. Further, the spreader plate 127 adds rigidity to the fabric 150 so that the fabric 150 may be more easily moved back and forth with the traversing plate 123 between guide rollers 123*b* and 123*c*, without becoming twisted or otherwise distorted.

As the fabric 150 is moved by the traversing plate 123 back and forth along the traversing control spindle 122, the knitted fabric is engaged by the takedown rollers 115 along substantially the entire working length of the takedown rollers 115. The working length of the takedown rollers 115 is approximately 4.5 inches to 5 inches. This, in turn, results in a fabric roll of approximately 4.5 inches to 5 inches in width.

Figure 7:
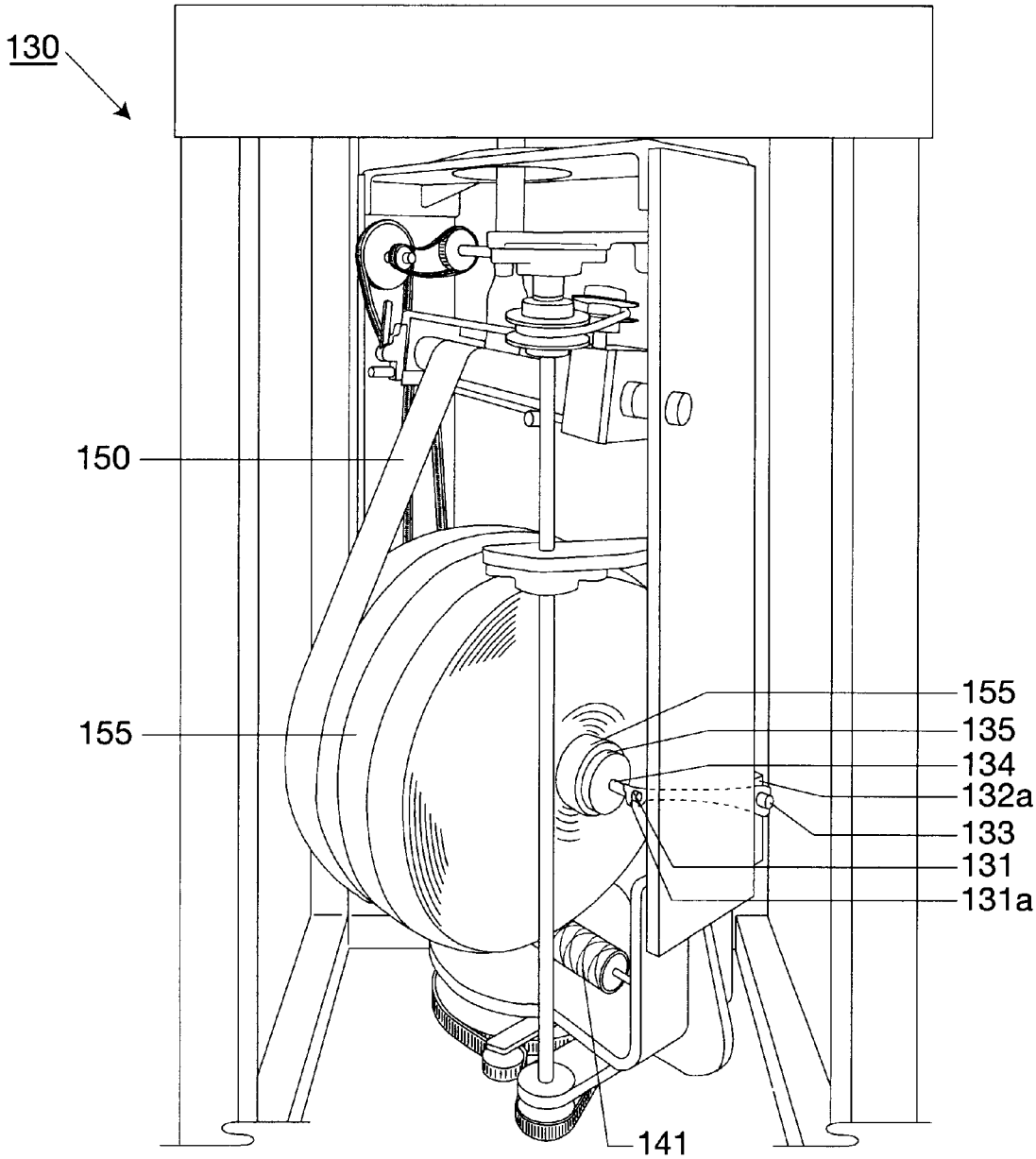
FIG. 7 is a front perspective view of the rollup and winding assembly of the present invention.
Figure 8:
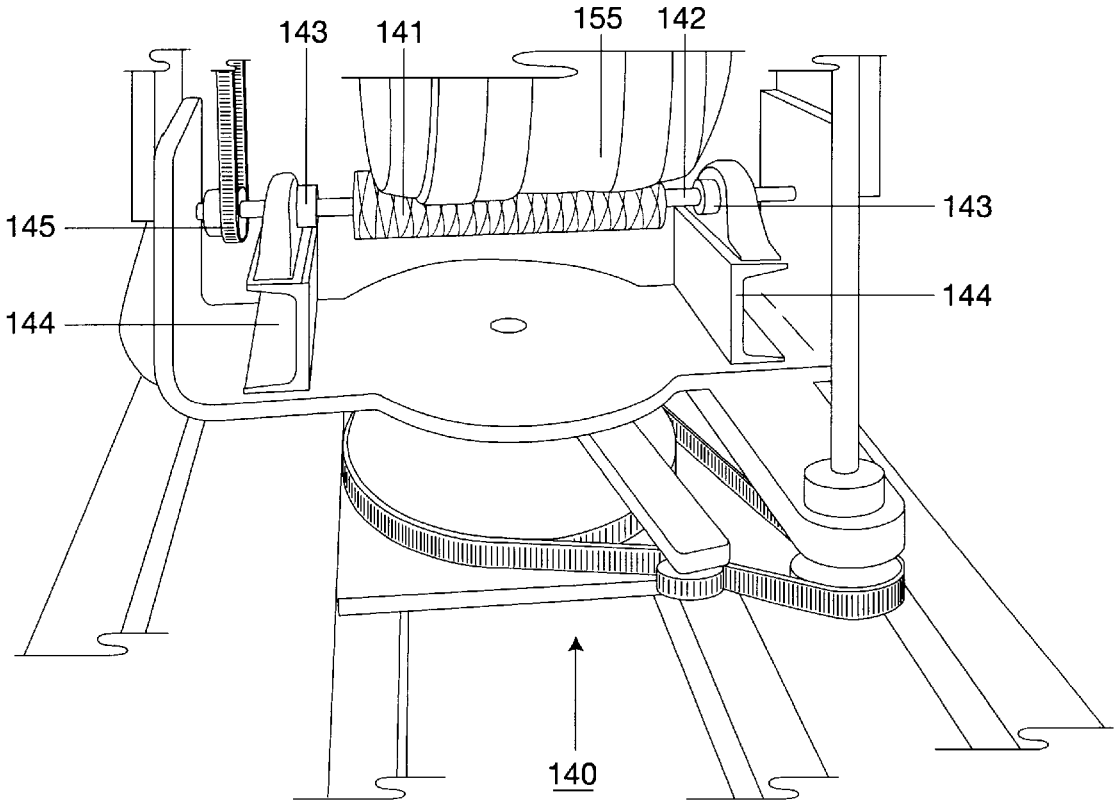
FIG. 8 is a front view of the windup assembly of FIG. 7.

As the takedown rollers engage the tubular knitted fabric 150, a large, wide roll is thus formed as the fabric is wound. FIGS. 7 and 8 show the size and shape of the resulting large roll. As described above, the prior art rolls that are wound about a clutch-controlled mandrel 16 are limited to the width of a single, flattened, knitted fabric tube and weigh approximately 1.5 pounds to 2 pounds. The rolls of the present invention will hold 5 to 10 times more fabric because of their increased width. As shown in FIG. 7, a takeup roller assembly 130 replaces the mandrel 16 and clutch 23 of the conventional prior art machines. A generally cylindrical, freely rotating, takeup roller 135 that is longer than the width of the fabric roll 155 to be formed is held in place by opposed arms 131 that are pivotally attached at their ends to the lower takedown bracket 114 at points 132*a* and 132*b* (132*b* not shown but identical to 132*a*) with fasteners 133, such as pins. Springs (not shown) are connected to the riser blocks 144 and arms 131 so that the arms are spring-biased downward. Notches 131*a* formed in the free ends of the arms 131 engage takeup roller extensions 134 on either end of takeup roller 135. In operation, the arms 131 bias the empty takeup roller 135 downward against the windup roller 141. As the windup roller 141 rotates, fabric 150 traverses from side to side to accumulate in the wide roll. As the diameter of the roll 155 increases, the takeup roller 135 moves upward aginst the bias as the arms 131 pivotally move upward as well about points 132*a* and 132*b*. In essence, then, the takeup roller 135 moves upward as the diameter of the roll 155 of fabric increases.

Referring to FIG. 8, the windup roller assembly 140 is shown in greater detail. As the takedown rollers 115 rotate, the shaft extension 116*a* with sprocket 119*b* and chain 129*c* that is interconnected to the sprocket 145 on windup shaft 142 causes the windup shaft to rotate, turning the windup roller 141. Windup roller 141 has a knurled surface along its length to frictionally engage the fabric roll 155. The ends of the windup roller shaft 142 are rigidly mounted within pillow block bearings 143. To provide sufficient clearance between windup roller 141 and the takedown bracket base, the pillow block bearings 143 are mounted atop riser blocks 144, or spacers, well known in the art. As those skilled in the art will appreciate, there are a number of ways that the windup roller 141 and pillow block bearings 143 may be mounted, so long as the windup roller 141 is spaced from the takedown bracket base. Because windup roller 141 is rotating at a fixed rate and is rolling the fabric 150 from the outside of the roll, a constant tension is applied to the wound fabric from the very beginning of the roll to the end. The sprocket ratios between sprocket 119*b* and sprocket 145 are fixed at a ratio of 1.25:1 so that the tension is less than the tension of the fabric 150 coming through the takedown rollers. As those skilled in the textile arts will appreciate, the amount of tension induced in the wound fabric is not critical as long as the same tension is applied throughout the entire roll of fabric.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. An apparatus for producing large rolls of tubular fabric knitted on a small diameter circular knitting machine of the type having fabric takedown rollers for pulling the fabric from the knitting cylinder, and a takeup roller for receiving the fabric from the takedown rollers for winding up the fabric into a roll, comprising:

(a) a traversing mechanism operatively associated with and positioned upstream of the tubular fabric takedown rollers so that the fabric is moved back and forth along the length of the takedown rollers as it moves therethrough; and (b) wherein the fabric roll wound upon the takeup roller extends along a length greater than the width of the fabric to provide larger packages.

2. The apparatus of claim 1 wherein the traversing mechanism is moved at a controlled variable linear speed resulting in a substantially uniform traversing rate of the fabric along the length of the takeup roller.

3. The apparatus of claim 2 wherein the traversing mechanism is operatively connected to and driven by the takedown rollers.

4. The apparatus of claim 2 wherein the traversing mechanism includes a control spindle, a traversing nut mounted on and moved linearly responsive to the control spindle, and a traversing guide plate which receives and guides the fabric back and forth in a path parallel to and upstream of the takedown rollers.

5. The apparatus of claim 4 wherein the control spindle has tracks that are of a steeper pitch at the ends of the spindle than in the middle of the spindle to slow down the traversing nut as it nears the ends of the spindle.

6. The apparatus of claim 5 wherein the tracks formed in the spindle have a pitch of about 68° in the middle of the spindle and about 76° at the ends of the spindle.

7. The apparatus of claim 1 wherein the fabric is delivered to a takeup roller by a surface engaging windup roller that is connected to and driven responsive to the movement of the takedown rollers, wherein the windup roller causes the fabric to be wound at a constant speed to maintain a constant tension.

8. The apparatus of claim 1 wherein the amount of fabric wound upon the takeup roller is between about 5 and 10 times the amount of the same fabric wound on a conventional mandrel for fabric of this type.

9. An apparatus for producing large rolls of tubular fabric knitted on a small diameter knitting machine of the type having fabric takedown rollers for pulling the fabric from the knitting cylinder, and a takeup roller for receiving the fabric from the takedown rollers for winding up the fabric into a roll, comprising:

(a) a surface engaging windup roller mounted at a predetermined distance downstream of said takedown rollers, the windup roller being operatively connected to said takedown rollers and driven responsive thereto at a constant angular velocity;

(b) the takeup roller being freely rotatable and biased toward the windup roller, whereby the fabric being wound on the takeup roller is engaged by and moved by the windup roller at a constant surface speed; and (c) whereby the fabric is wound on the takeup roller at a substantially constant tension.

10. The apparatus according to claim 9 and further including a traversing mechanism operatively associated with the takedown rollers to create a fabric roll having a width greater than the width of the tubular fabric to create larger packages.

11. The apparatus of claim 10 wherein the traversing mechanism is positioned upstream of the tubular fabric takedown rollers so that the fabric is moved back and forth along the length of the takedown rollers as it moves therethrough and is delivered to the takeup roller in substantially a vertical path.

12. The apparatus of claim 9 wherein the surface speed of the windup roller with respect to the surface speed of the takedown rollers is at a ratio of between about 1.2:1 and 1.5:1.

13. A small diameter circular knitting machine, comprising (a) a knitting cylinder (b) a plurality of fabric takedown rollers for pulling fabric from the knitting cylinder;

(c) a takeup roller for receiving the fabric from the takedown rollers for winding the fabric into a roll;

(d) a traversing mechanism operatively associated with and positioned upstream of the tubular fabric takedown rollers so that the fabric is moved back and forth along the length of the takedown rollers as it moves therethrough; and (e) wherein the fabric roll wound upon the takeup roller extends along a width greater than the width of the fabric to provide larger packages.

14. The apparatus of claim 13 wherein the traversing mechanism is moved at a controlled variable linear speed resulting in a substantially uniform traversing rate of the fabric along the length of the takeup roller.

15. The apparatus of claim 14 wherein the traversing mechanism is operatively connected to and driven by the takedown rollers.

16. The apparatus of claim 14 wherein the traversing mechanism includes a control spindle, a traversing nut mounted on and moved linearly responsive to the control spindle, and a traversing guide plate which receives and guides the fabric back and forth in a path parallel to and upstream of the takedown rollers.

17. The apparatus of claim 16 wherein the control spindle has tracks that are of a steeper pitch at the ends of the spindle than in the middle of the spindle to slow down the traversing nut as it nears the ends of the spindle.

18. The apparatus of claim 17 wherein the tracks formed in the spindle have a pitch of about 68° in the middle of the spindle and about 76° at the ends of the spindle.

19. The apparatus of claim 13 wherein the fabric is delivered to a takeup roller by a surface engaging windup roller that is connected to and driven responsive to the movement of the takedown rollers, wherein the windup roller causes the fabric to be wound at a constant speed to maintain a constant tension.

20. The apparatus of claim 13 wherein the amount of fabric wound upon the takeup roller is between about 5 and 10 times the amount of the same fabric wound on a conventional mandrel for fabric of this type.

21. A small diameter circular knitting machine, comprising:

(a) a knitting cylinder and dial;

(b) a plurality of fabric takedown rollers for pulling fabric from the knitting cylinder;

(c) a takeup roller for receiving the fabric from the takedown rollers for winding the fabric into a roll;

(d) a surface engaging windup roller mounted at a predetermined distance downstream of said takedown rollers, the windup roller being operatively connected to said takedown rollers and driven responsive thereto at a constant angular velocity;

(e) the takeup roller being freely rotatable and biased toward the windup roller, whereby the fabric being wound on the takeup roller is engaged by and moved by the windup roller at a constant surface speed; and (f) whereby the fabric is wound on the takeup roller at a substantially constant tension.

22. The apparatus according to claim 21 and further including a traversing mechanism operatively associated with the takedown rollers to create a fabric roll having a width greater than the width of the tubular fabric to create larger packages.

23. The apparatus of claim 22 wherein the traversing mechanism is positioned upstream of the tubular fabric takedown rollers so that the fabric is moved back and forth along the length of the takedown rollers as it moves therethrough and is delivered to the takeup roller in substantially a vertical path.

24. The apparatus of claim 21 wherein the surface speed of the windup roller with respect to the surface speed of the takedown rollers is at a ratio of between about 1.2:1 and 1.5:1.

25. A method for forming large rolls of tubular fabric knitted on a small diameter circular knitting machine of the type having fabric take-down rollers for pulling the fabric from the knitting cylinder, and a takeup roller for winding the fabric into a roll, comprising:

(a) engaging the tubular fabric between the knitting cylinder and the takedown rollers by a traversing mechanism that moves the fabric back and forth along the length of the take down rollers; and (b) winding the fabric on a takeup roller to form a fabric package wider than the width of the tubular fabric.

26. The method of claim 25 wherein the traversing mechanism is moved at a controlled variable linear speed which results in a substantially uniform traversing rate of the fabric along the length of the takeup roller.

27. The method of claim 25 wherein the fabric is fed from the takedown rollers to the takeup roller by a surface engaging mechanism that moves at a constant speed and induces a constant tension on the tubular fabric.

28. A rolled package of small diameter tubular knitted fabric for use in making knit cuffs and holding at least five times the amount of tubular knit fabric as a roll the width of the tubular knit fabric, the fabric on the roll being under substantially constant tension and the surface of the fabric package being relatively even along its width.

* * * * *